United States Patent [19]

Brown et al.

[11] 4,150,634

[45] Apr. 24, 1979

[54] INTEGRATED MOTOR CONTROLLER FOR SEWING MACHINES

[75] Inventors: Jack Brown, Union; John A. Herr, Garwood; Wesley R. Peterson, Bound Brook; John W. Wurst, Dover, all of N.J.

[73] Assignee: The Singer Company, New York, N.Y.

[21] Appl. No.: 907,459

[22] Filed: May 19, 1978

[51] Int. Cl.[2] ..... D05B 69/22

[52] U.S. Cl. ..... 112/275; 112/261

[58] Field of Search ..... 112/275, 277, 121.11, 112/261, 220

[56] References Cited

U.S. PATENT DOCUMENTS

| | | | |
|---|---|---|---|
| 3,019,751 | 2/1962 | Fichera | 112/261 |
| 3,217,679 | 11/1965 | Novak | 112/277 |
| 3,661,105 | 5/1972 | Rohr | 112/277 X |
| 4,075,961 | 2/1978 | Harris | 112/277 |

*Primary Examiner*—Peter Nerbun

*Attorney, Agent, or Firm*—Michael H. Wallach; Robert E. Smith; Edward L. Bell

[57] ABSTRACT

A controller to permit a sewing machine operator to control a sewing machine drive motor from control members located in close proximity to the needle bar. Means are provided to permit the operator to select the sewing speed and the needle stop position prior to commencing the sewing process. The operator may thereafter control the sewing process by light finger pressure applied to the control members without attention being distracted from the work feeding area. The operator may suspend the sewing process by removing pressure from the control members. The sewing machine will thereafter stop with the needle bar in the selected position. A reset circuit is provided to prevent the operator from unintentionally actuating the sewing machine drive motor.

12 Claims, 7 Drawing Figures

Fig. 5
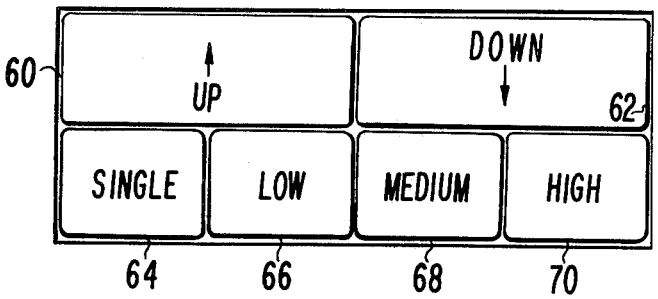
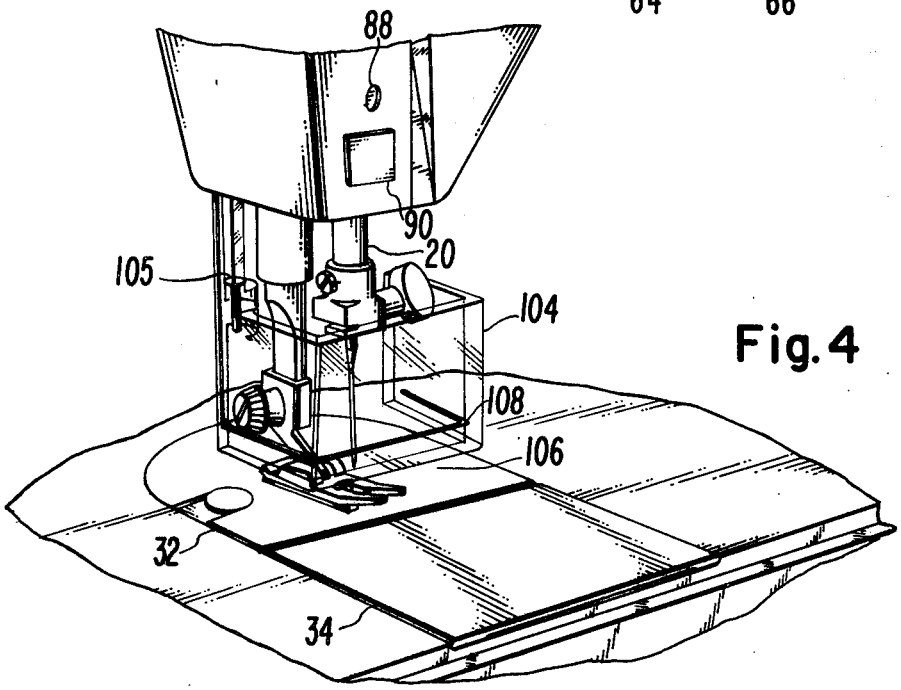
Fig. 4
Fig. 7
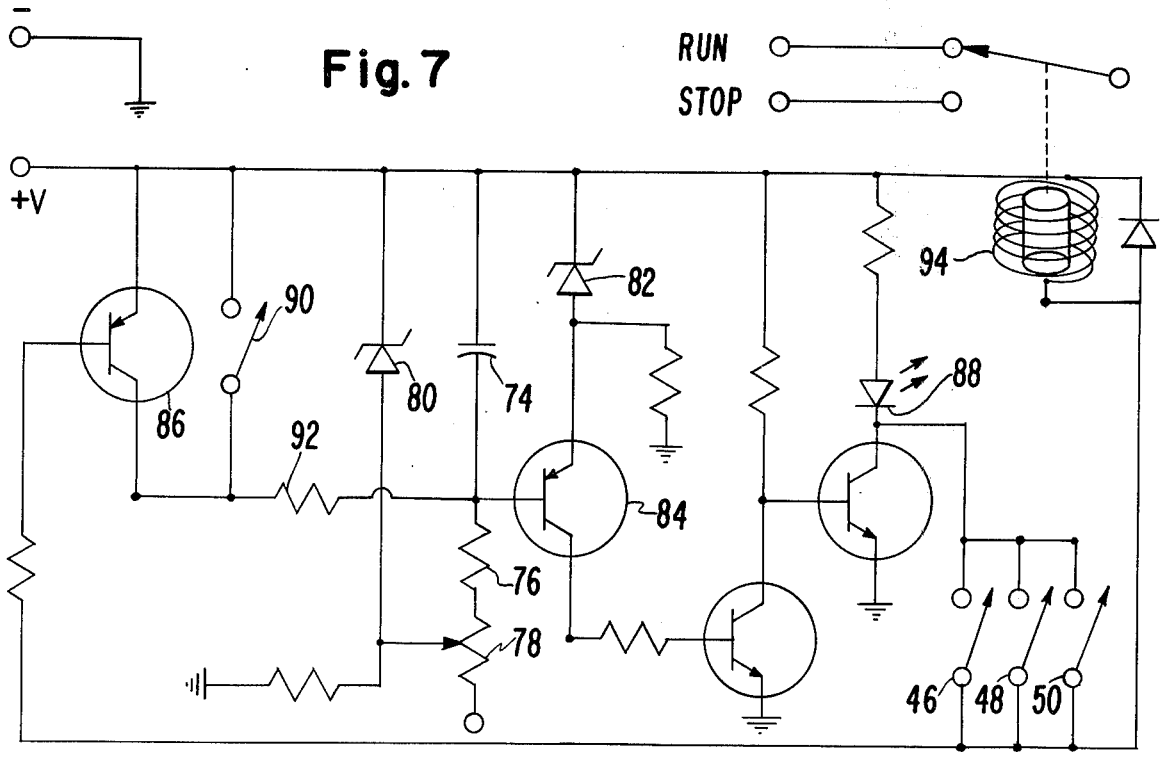

INTEGRATED MOTOR CONTROLLER FOR SEWING MACHINES

BACKGROUND OF THE INVENTION

1. Field of the Invention

This invention relates to sewing machines in general and more particularly to a controller for varying the speed of a sewing machine electric drive motor.

2. Description of the Prior Art

It is desirable to be able to start and stop the drive motor of a sewing machine while guiding the work piece with both hands. A common solution to this problem in the prior art of electrically operated sewing machines is to control the drive motor with a foot or knee operated remote control switch. While such a control has the advantage of keeping both hands of the operator free to guide the work piece while still permitting the motor to be rapidly started or stopped, the use of a foot or knee operated switch produces attendant problems.

One problem with prior art foot operated controllers is that they must be placed in position each time that the sewing machine is moved.

Another problem is that foot operated controllers are susceptible to being kicked out of position by extraneous foot movements.

Still another problem is that knee operated controllers must be rigidly attached to the sewing machine support table.

SUMMARY OF THE INVENTION

It is an object of this invention to provide a sewing machine motor controller which does not have to be reconnected each time the sewing machine is moved.

Another object of this invention is to provide a means for controlling the motor of a sewing machine without having to redirect visual attention away from the needle and work piece.

Still another object of this invention is to provide a sewing machine motor controller which permits the selection of the position which the needle will assume when it is stopped.

It is also an object of this invention to provide a controller which will permit the operator to guide the work piece with two hands.

The disclosed objects and other advantages of this invention are achieved by placing control members for operating the drive motor in the vicinity of the needle bar of the sewing machine. A set of motor function selection switches are disposed on the sewing machine in a position which is conveniently accessible to the operator. The motor function selection switches permit the operator to select the operating speed of the motor and the position which the needle will assume when the motor is stopped. A reset circuit is provided which allows the operator only a fixed period of time during which sewing may be suspended. The operator prepares for operation of the sewing machine by selecting the motor operating speed and needle stop position through the use of the motor function selection switches, and by actuating the reset circuit. The sewing machine may thereafter be started by applying light finger pressure to a control member located in the vicinity of the needle bar. If the operator does not touch the control member to begin sewing before the time interval set by the reset circuit lapses, or if the operator stops sewing for an interval of time greater than that set by the reset circuit, the reset circuit must be reactivated before the sewing process may by resumed. The operator may thereafter control the drive motor by applying light finger pressure to the control member.

BRIEF DESCRIPTION OF THE DRAWINGS

The above and other objects of this invention will be evident from an understanding of the preferred embodiment which is hereinafter set forth in such detail as to enable those skilled in the art to readily understand the function, operation, construction, and advantages of it when read in conjunction with the accompanying drawings in which:

FIG. 4 is a view similar to FIG. 3 showing an alternate embodiment of a control member which may be used to control the drive motor;

FIG. 5 is an illustration of motor function selection switches which may be used in connection with the control member shown in FIG. 4;

FIG. 7 is an electronic schematic diagram of a reset circuit which may be used to control the restarting of the sewing machine drive motor.

DESCRIPTION OF THE PREFERRED EMBODIMENT

Figure 1:
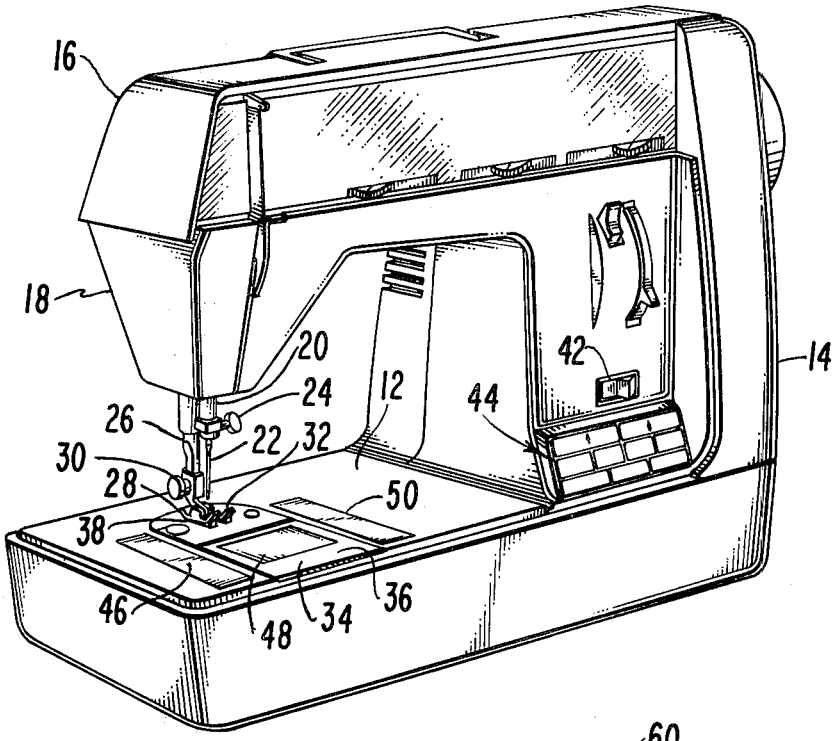
FIG. 1 is a perspective view of a sewing machine incorporating a controller constructed in accordance with the principles of this invention.

Referring to the drawings, FIG. 1 shows a conventional sewing machine having a bed 12. A standard 14 rises from the bed 12 and supports an arm 16 which overhangs the bed 12 and terminates in a sewing head 18. Journalled in the sewing head 18 and adapted for endwise reciprocatory stitch forming motion is a needle bar 20. The needle bar 20 has a needle 22 clamped thereto by a needle clamp 24. A presser bar 26 having a presser foot 28 removably attached thereto by a thumbscrew 30 is also journalled in the sewing head 18. A throat plate 32 and a bed plate 34 enclose a cavity 36 formed in the bed 12 of the sewing machine. The presser foot 28 cooperates with a feed dog 38 which rises through a set of slots formed in the throat plate 32 and which moves fabric to be sewn relatively to the endwise path of the needle 22.

Figure 6:
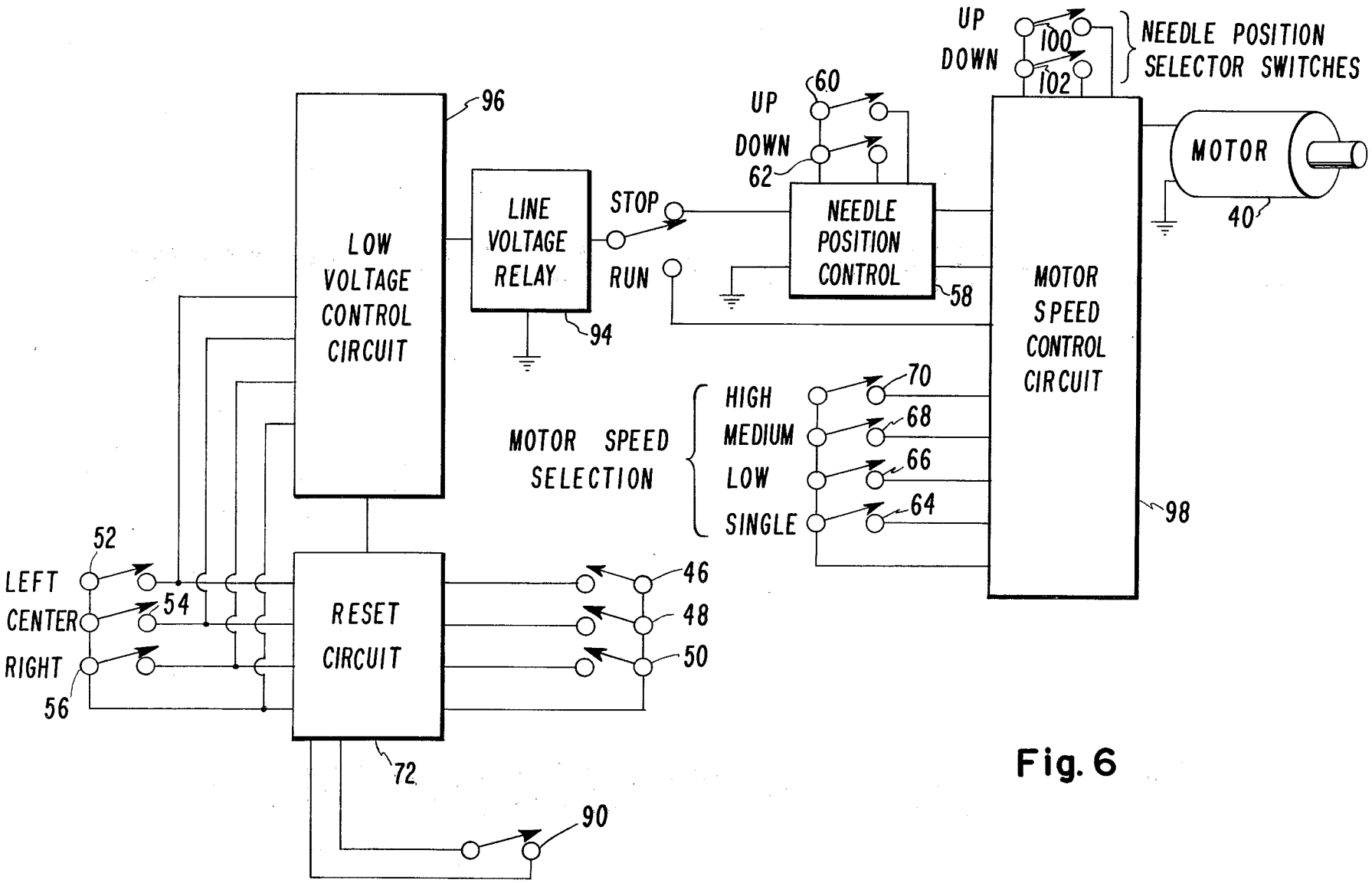
FIG. 6 is an electronic block diagram showing the relation between the motor function selection switches, the motor control members, a reset circuit, and the needle position sensors which cooperate to perform the objects of this invention.

The needle bar 20 and the feed dog 38 are imparted motion by an electrically operated motor 40 enclosed within the standard 14 and shown schematically in FIG. 6. A switch 42 is employed to control the electrical power supplied to the sewing machine. A plurality of motor function selection switches are clustered on a switch panel which is shown generally at 44 in FIG. 1 and which is shown in greater detail in FIG. 2.

The bed 12 of the sewing machine is shown preferably having a plurality of motor control members which consist of a first control member 46 preferably positioned on the bed 12 to the left side of the cavity 36, a second control member 48 preferably positioned on the bed plate 34, and a third control member 50 preferably positioned on the bed 12 to the right side of the cavity 36. It will be appreciated by one skilled in the art of sewing that the three disclosed control members form but one possible arrangement of motor control members and are preferably disposed in sufficiently close proximity to the sewing area to easily permit a machine operator to depress an area with light finger pressure while feeding a work piece under the sewing head 18 without having to redirect visual attention away from the area of the needle 22. The control members 46, 48 and 50 are preferably momentary contact switches which may be activated with light finger pressure applied either directly to the switch or through the work fabric and which will complete an electrical circuit only as long as pressure is applied thereto.

Figure 2:
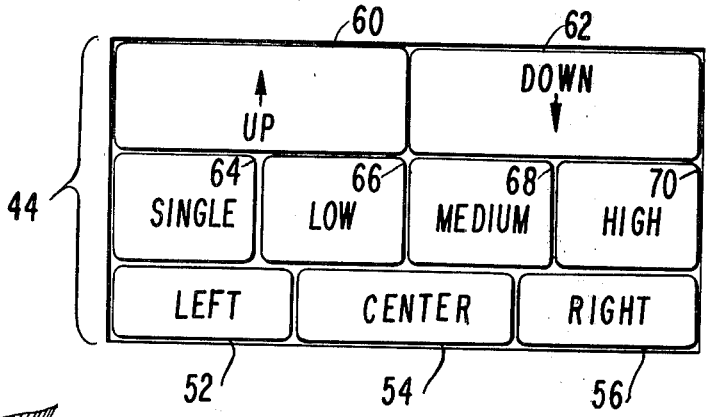
FIG. 2 is an illustration of the motor function selection switches.

Referring to FIG. 2, the switch panel 44 is shown containing a switch 52 marked "Left", a switch 54 marked "Center", and a switch 56 marked "Right". The switches 52, 54 and 56 allow the sewing machine operator to select the appropriate control member (either 46, 48 or 50) disposed about the stitch forming area that will be utilized to control the operation of the sewing machine motor 40. Selection of the first control member 46 is accomplished by depressing the "Left" switch 52; selection of the second control member 48 is accomplished by depressing the "Center" switch 54; and selection of the third control member 50 is accomplished by depressing the "Right" switch 56. The sewing machine drive motor 40 may thereafter be operated by the application of light finger pressure on the selected control member 46, 48 or 50.

A sewing machine which may advantageously employ a preferred embodiment of the disclosed invention preferably also has contained therein a means for detecting when the needle bar 20 is in its highest position and when it is in its lowest position, such as the means disclosed in U.S. Pat. No. 3,503,352 granted to Peterson on Nov. 31, 1970, the rights to which are owned by the assignee of this invention. The needle position detecting means are shown schematically in FIG. 6 at 100 and 102. When the needle bar 20 is in its lowest position the needle 22 is penetrating through the work piece, and when it is in its highest position the needle 22 is removed from the work piece. It will be appreciated that for some sewing operations it is advantageous for the sewing machine to be stopped with the needle 22 in the raised position so that the work piece can be repositioned or removed from the sewing machine, while at other times it is advantageous for the needle 22 to remain in the work piece, as for example when the work piece is to be pivoted about the needle 22. The operator may specify that the sewing machine is to stop with the needle 22 in the raised position by operating a switch 60. A switch 62 is provided for stopping the needle in the lowered position.

The speed at which the sewing machine drive motor 40 is to operate may be selected by depressing one of the pushbuttons 64, 66, 68 or 70. The sewing machine will operate at the selected speed each time that the motor 40 is energized and until such time that a new operating speed is selected. It is to be remembered that the motor 40 will not operate until the desired control member has been selected by depressing one of the pushbuttons 52, 54 or 56 and pressure is applied to the associated control member 46, 48 or 50.

A reset circuit which is shown generally in FIG. 6 at 72 and which is shown in greater detail in FIG. 7 is advantageously employed as a safety device which will prevent the accidental starting of the sewing machine after finger pressure has been released from a motor control member for a fixed interval of time, but while the operator still has a hand in the stitch forming area of the needle bar 20, as for example while a work piece is being repositioned. FIG. 6 shows that when one of the control member selection pushbuttons 52, 54 or 56 is depressed, the reset circuit 72 will be reset, thereby permitting the operation of the drive motor 40. It will be understood that if the operator does not resume sewing by reactivation of the originally selected motor control member 46, 48 or 50 before the time interval set by the reset circuit 72 expires, the operator will be required to once again depress one of the control member selection pushbuttons 52, 54 or 56 thereby resetting the circuit 72 and allowing operation of the drive motor 40 to be resumed by operation of the selected control member, either 46, 48 or 50.

FIG. 7 shows an electronic circuit which may be used to perform the reset function. When the operator releases pressure from one of the motor control members 46, 48 or 50 a transistor 86 stops conducting and allows the capacitor 74 to begin charging through a resistor 76 and a potentiometer 78. The voltage to which the capacitor is charged is controlled by a zener diode 80, a zener diode 82, and the forward voltage drop across the base and emitter junctions of a transistor 84. When the capacitor 74 is fully charged, the transistor 84 begins to conduct and a light emitting diode 88 is turned off, thereby indicating that the sewing machine will not operate until the circuit 72 has been reset. The operator may reset the circuit 72 by momentarily depressing a reset pushbutton 90 which causes the capacitor 74 to discharge through a resistor 92. When the capacitor 74 is discharged, the transistor 84 is turned off and the transistor 86 is turned on thereby allowing a relay 94 to be closed when one of the control members 46, 48 or 50 are closed. The drive motor 40 will thereafter be supplied with power through the relay 94 and will operate as long as the operator continues to depress one of the motor control members 46, 48 or 50. It will be appreciated that the length of time during which the operator may stop sewing without having to operate the reset pushbutton 90 is controlled by the length of time that it takes to charge the capacitor 74, which may be adjusted by changing the resistance of the potentiometer 78. Preferably, the reset circuit may be adjusted to provide a time interval of from one to six seconds during which sewing may be suspended without having to reset the reset circuit. It is to be understood that while the reset circuit 72 shown in FIG. 7 has but one reset pushbutton 90 shown thereon, the function of the reset pushbutton may be provided by a switching element incorporated within each of the control member selection switches 52, 54 and 56, in which instance it will not be necessary to provide a separate switch to perform the reset function.

FIG. 6 is an electrical block diagram of a sewing machine having the preferred embodiment of this invention applied thereto. Shown at 96 is a low voltage control circuit, the specific construction details of which are not required for a complete understanding of this invention. The reset circuit 72 is shown having the reset pushbutton 90 attached thereto, whose function as hereinbefore noted could be replaced with switching elements integrally attached to the switches 52, 54 and 56. If the operator applies light finger pressure to the appropriate control member 46, 48 or 50 before the time set by the reset circuit 72 has expired, the low voltage control circuit 96 will operate the relay 94 which will connect the line voltage supply to a motor speed control circuit 98. It is to be understood that the motor speed control circuit 98 may be any circuit which will permit the sewing machine drive motor 40 to operate at a plurality of discrete incremental speeds. The speed at which the drive motor 40 will operate may be selected by the motor speed selection pushbuttons 64, 66, 68 and 70 which are connected to the motor speed control circuit 98.

FIG. 6 also shows a needle position sensor 100 for sensing when the needle is in the raised position and a needle position sensor 102 for sensing when the needle is in the lowered position. The needle position selector switches 60 and 62, which may be used by the sewing machine operator to specify whether the needle is to stop in the raised or the lowered position respectively, are connected to the motor speed control circuit 98 through the needle position control circuit 58, the exact details of which are not required for a complete understanding of this invention. When the sewing machine operator releases the control member 46, 48 or 50 the needle position control circuit 58 will continue to operate the drive motor 40 through the motor speed control circuit 98 until the appropriate needle position sensor 100 or 102 signals that the needle 22 has been driven to the position selected by the needle position selector switches 60 or 62. The needle position control circuit 58 will thereafter disconnect the drive motor 40.

Figure 3:
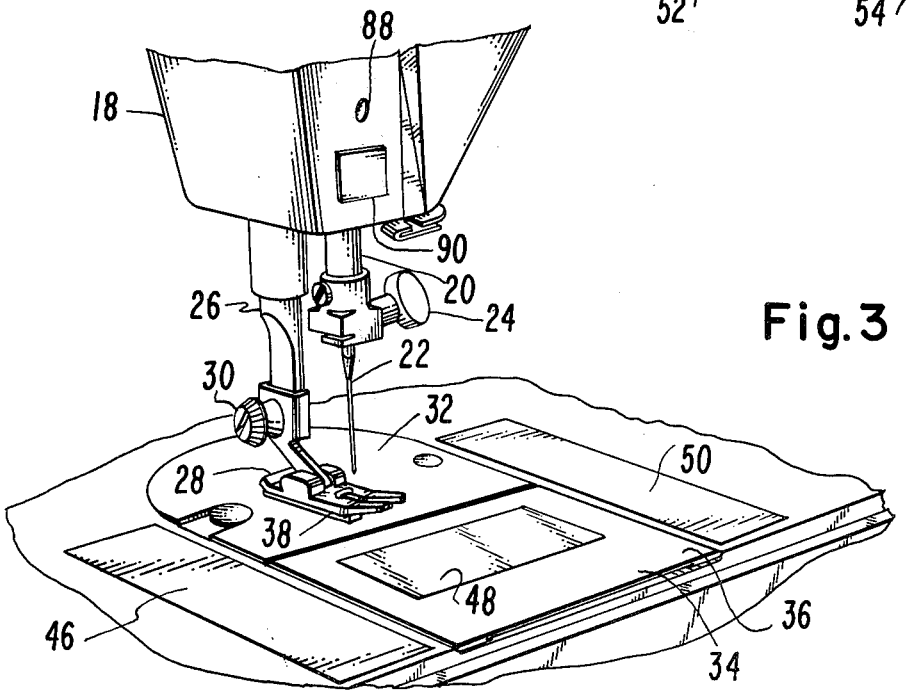
FIG. 3 is a perspective view of the sewing head and throat plate area of a sewing machine having motor control members and a reset switch attached thereto.

FIGS. 3 and 5 show an alternate embodiment of the integrated motor controller which eliminates the need for the control member selection switches 52, 54 and 56. The motor function selection switches for the alternate embodiment are shown in FIG. 5 and include the pushbuttons 60 and 62 to select whether the needle is to stop in the raised or lowered position respectively, and the pushbuttons 64, 66, 68 and 70 with which one of four motor speeds may be selected. The needle bar 20 has disposed about it the three control members 46, 48 and 50 which are substantially similar to the control members employed in the preferred embodiment shown in FIG. 1. FIG. 3 shows the sewing head 18 having the light emitting diode 88 and the reset pushbutton 90 whose functions have heretofore been fully described, attached thereto.

An operator initiates sewing on a sewing machine having the features of the alternate embodiment attached thereto by selecting whether the needle is to stop in the raised or lowered position by activating the pushbutton 60 or pushbutton 62 respectively, and depressing one of the four motor speed selector pushbuttons 64, 66, 68 or 70. The operator may then activate the drive motor 40 by operating the reset pushbutton 90 to reset the circuit 72 and then depressing one of the control members 46, 48 or 50 disposed in the stitch forming area of the needle bar 20. If the operator removes finger pressure from the selected control member, the drive motor 40 will stop with the needle 22 in the selected stop position. The operator may restart the drive motor 40 before the time interval set by the reset circuit 72 has elapsed by depressing any of the three control members 46, 48 or 50. The light emitting diode 88 will remain illuminated until the time interval set by the reset circuit 72 has elapsed after which the diode 88 will turn off and it will be necessary for the operator to activate the reset switch 90 before restarting the motor 40 from any of the three control members 46, 48 or 50. The operator of a sewing machine having a controller constructed in accordance with the teachings of the alternate embodiment may freely shift control of the drive motor 40 to any of the selected motor control members 46, 48 or 50 without being required to first operate a control member selection pushbutton 52, 54 or 56.

FIG. 4 shows a second alternate embodiment of the integrated motor controller. A needle guard 104 is preferably formed from a clear material to substantially enclose three sides of the area in which the needle 22 reciprocates. The needle guard 104 is attached to the sewing head 18 with an attachment means 105 which permits it to be readily swung away from the needle 22 to facilitate replacement of the needle 22. The needle guard 104 is supported above the throat plate 32, thereby forming a slot 106 between the needle guard 104 and the throat plate 32 to permit the passage of fabric between the feed dog 38 and the needle 22. The needle guard 104 has a switch area 108 contained thereon that is sensitive to the presence of a sewing machine operator's hand or finger, as for example a momentary contact switch or a capacitively coupled switch. The switch area 108 performs the control function performed by the control members 46, 48 and 50 shown in FIG. 1. The controller of the second alternate embodiment has a control panel which is of the same configuration as that used in the first alternate embodiment which is shown in FIG. 5 and which incorporates the pushbuttons 60 and 62 for selectively stopping the needle in either the raised position or the lowered position, respectively, and the pushbuttons 64, 66, 68 and 70 for selecting the operating speed of the sewing machine motor 40. It is also to be understood that the switching function performed by the switch area 108 could be performed by any form of momentary contact switch capable of closing an electrical circuit.

The operation of a sewing machine having an integrated motor controller incorporated therein commences with connecting the sewing machine to an electrical source via operation of the switch 42. The operator then selects whether the needle 22 is to stop in the raised or lowered position by depressing either the pushbutton 60 or the pushbutton 62. The operator then selects the sewing speed by operating one of the four pushbuttons 64, 66, 68 or 70. If the sewing machine is equipped with an integrated motor controller constructed in accordance with the teachings of the preferred embodiment, the control member from which the operator will control the operation of the drive motor 40 is selected by depressing the pushbutton 52, the pushbutton 54, or the pushbutton 56. The sewing machine drive motor 40 will begin operating when the operator places a finger on the appropriate control member 46, 48 or 50. The operator will not have to select a control member if the sewing machine has a controller embodying the teachings of the alternate or second alternate embodiment. The sewing machine may be stopped by the sewing machine operator removing pressure from the selected control member. If the operator removes pressure from the control member for a length of time that is less than that set by the reset circuit 72, the sewing machine may be reactivated by once again applying pressure to the selected control member. If, however, the operator removes pressure from the control member for a length of time that is greater than that set by the reset circuit 72, the operator will be required to reset the circuit 72 before sewing may be resumed. The operator will thereafter be able to operate the sewing machine by applying pressure to the selected control member.

It will be appreciated that modifications and variations of the described invention may become evident to one skilled in the art in light of the above teachings. For example, the number, size and location of control members from which the motor may be controlled may be varied, as may the number of functions which may be selected by push button control. Construction details of the reset circuit described in the preferred embodiment may also be varied. It is to be understood that such variations may be made to the preferred embodiment without departing from the spirit and scope of the invention as defined in the appended claims.

Having thus set forth the nature of the invention, what is claimed herein is:

1. A motor controller for a sewing machine having an electrically operable drive motor, a needle bar, an armshaft including means for connecting said needle bar to said drive motor for endwise reciprocatory stitch forming motion of said needle bar toward and away from a stitch forming location, at least one control member disposed in close proximity to said stitch forming location, said control member comprising at least one momentary contact switch having an open position and a closed position, said momentary contact switch being operable by light hand pressure of a sewing machine operator and connecting said drive motor to a source of electrical power, said control member remaining closed only when said light hand pressure remains on said momentary contact switch, a selector means for selecting which of said control members will activate said drive motor, a reset circuit which disconnects said control members from said drive motor after said control members have remained open for a specified interval of time, and an operator influenced reset means for resetting said reset circuit.

2. The arrangement as set forth in claim 1 wherein said reset circuit includes a signalling means for advising a sewing machine operator when said reset circuit has disconnected said drive motor from said control members.

3. The arrangement as set forth in claim 1 wherein the length of time during which an operator may interrupt the sewing process without being required to reset said reset circuit is controlled by the length of time required to charge a capacitor.

4. The arrangement as set forth in claim 1 wherein said selector means are integrally incorporated into said control members, whereby said sewing machine motor may be operated by actuation of any of said control members without selecting which of said control members will control said motor.

5. The arrangement as set forth in claim 1 wherein said selector means include integral therewith means for resetting said reset circuit when said selector means are operated to select which of said control members will control said drive motor.

6. The arrangement as set forth in claim 1 further comprising a needle bar position sensing means for determining when said needle bar is in a raised position and when said needle bar is in a lowered position, a means for selecting whether said needle bar will stop in a raised position or a lowered position, and means for operating said drive motor to move said needle bar to said raised or said lowered position after pressure is released from said control member.

7. The arrangement as set forth in claim 1 further comprising an operator influenced means for selecting from a plurality of discrete operating speeds for said drive motor.

8. A motor controller for a sewing machine having an electrically operable drive motor, a needle bar, an armshaft including means for connecting said needle bar to said drive motor for endwise reciprocatory motion of said needle bar, a needle guard formed about said needle bar, said needle guard having a momentary contact switch attached thereto, said momentary contact switch having an open position and a closed position and operating said drive motor when pressure is applied to said needle guard, a reset circuit means which disconnects said momentary contact switch from said drive motor after said momentary contact switch has remained open for a specified interval of time set by said reset circuit, and an operator influenced reset means for resetting said reset circuit.

9. The arrangement as set forth in claim 8 further comprising a needle bar position sensing means for determining when said needle bar is in a raised position and when said needle bar is in a lowered position, a means for selecting whether said needle bar will stop in a raised position or a lowered position, and means for operating said drive motor to move said needle bar to said raised or said lowered position after pressure is released from said needle guard.

10. The arrangement as set forth in claim 8 further comprising an operator influenced means for selecting from a plurality of discrete operating speeds for said drive motor.

11. The arrangement as set forth in claim 8 wherein said momentary contact switch comprise a capacitively coupled switch, said switch remaining closed while a human hand remains in close proximity to said switch.

12. The arrangement as set forth in claim 8 wherein the length of time during which an operator may interrupt the sewing process without being required to reset the reset circuit is controlled by the length of time required to charge a capacitor.

* * * * *